US008888258B2

(12) United States Patent
Kondou et al.

(10) Patent No.: US 8,888,258 B2
(45) **Date of Patent: *Nov. 18, 2014**

(54) PRINTING LIQUID CONTAINER, PRINTING LIQUID FILLED CONTAINER, IMAGE FORMING APPARATUS AND PRINTING LIQUID FILLED CONTAINER MANUFACTURING METHOD

(71) Applicant: FUJIFILM Corporation, Tokyo (JP)

(72) Inventors: Masahiko Kondou, Kanagawa (JP); Tomohisa Yoshida, Ebina (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/916,601

(22) Filed: Jun. 13, 2013

(65) Prior Publication Data

US 2013/0271536 A1 Oct. 17, 2013

Related U.S. Application Data

(63) Continuation of application No. PCT/JP2011/077734, filed on Nov. 24, 2011.

(30) Foreign Application Priority Data

Dec. 20, 2010 (JP) ..... 2010-283432

(51) Int. Cl.
*B41J 2/175* (2006.01)

(52) U.S. Cl.
CPC ..... *B41J 2/17523* (2013.01); *B41J 2/1752* (2013.01); *B41J 2/17513* (2013.01); *B41J 2/17553* (2013.01); *B41J 2/17559* (2013.01)
USPC ..... 347/86; 141/329

(58) Field of Classification Search
USPC ..... 347/84–86; 141/329; 215/247; 277/371, 277/626, 627; 604/86, 88, 256, 264, 415, 604/905
See application file for complete search history.

(56) References Cited

U.S. PATENT DOCUMENTS 4,928,126 A * 5/1990 Asai ..... 347/86
5,488,401 A * 1/1996 Mochizuki et al. ..... 347/86

(Continued)

FOREIGN PATENT DOCUMENTS

EP 0679585 A1 11/1995
EP 1090767 A2 4/2001

(Continued)

OTHER PUBLICATIONS

Japanese Office action with partial English translation, dated Sep. 17, 2013, from the Japanese Patent Office in a Japanese patent application corresponding to the instant patent application.

(Continued)

*Primary Examiner* — Anh T. N. Vo
(74) *Attorney, Agent, or Firm* — SOLARIS Intellectual Property Group, PLLC

(57) ABSTRACT

The present invention provides a printing liquid container, a printing liquid filled container, an image forming apparatus, and a printing liquid filled container manufacturing method that may enlarge the opening surface area in a seal membrane. Namely, the printing liquid container includes: a sealing membrane provided to a capping section for sealing an opening in the capping section; a contact portion formed in a central portion of the sealing membrane, the contact portion is contacted by a hole piercing tool for forming a hole in the sealing membrane; and a first rupture portion configured thinner than the sealing membrane and extending out from the contact portion to an outer peripheral portion of the sealing membrane.

17 Claims, 14 Drawing Sheets

(56) References Cited

U.S. PATENT DOCUMENTS

| | | | | |
|---|---|---|---|---|
| 6,554,412 | B1 | 4/2003 | Seino et al. | |
| 6,739,709 | B2 * | 5/2004 | Nip | 347/86 |
| 8,579,424 | B2 * | 11/2013 | Haijima et al. | 347/86 |
| 2003/0042257 | A1 | 3/2003 | Uchiyama | |

FOREIGN PATENT DOCUMENTS

| | | | |
|---|---|---|---|
| FR | 2716669 | A1 | 9/1995 |
| FR | 2716668 | B1 | 4/1996 |
| JP | 7-267257 | A | 10/1995 |
| JP | 7-290717 | A | 11/1995 |
| JP | 8-053147 | A | 2/1996 |
| JP | H11-309869 | | 11/1999 |
| JP | 2001-199082 | A | 7/2001 |
| JP | 2004-299760 | A | 10/2004 |
| JP | 2007-038537 | A | 2/2007 |
| JP | 2010-235153 | A | 10/2010 |

OTHER PUBLICATIONS

Partial English language translation of the following: Office action dated Jan. 7, 2014 from the Japanese Patent Office in a Japanese patent application corresponding to the instant patent application. This office action translation is submitted now in order to supplement the understanding of patent document JPH11-309869 which is cited in the office action and is being disclosed in the instant Information Disclosure Statement.

Written Opinion of the ISA issued in International Application No. PCT/JP2011/077734 mailed on Jan. 17, 2012.

International Search Report issued in International Application No. PCT/JP2011/077734 mailed on Jan. 17, 2012.

Partial English language translation of the following: Office action dated Sep. 10, 2014 from the SIPO in a Chinese patent application corresponding to the instant patent application.

* cited by examiner

PRINTING LIQUID CONTAINER, PRINTING LIQUID FILLED CONTAINER, IMAGE FORMING APPARATUS AND PRINTING LIQUID FILLED CONTAINER MANUFACTURING METHOD

CROSS-REFERENCE TO RELATED APPLICATIONS

This application is a continuation application of International Application No. PCT/JP2011/077734, filed on Nov. 24, 2011, which is incorporated herein by reference in its entirety. Further, this application claims priority from Japanese Patent Application No. 2010-283432, filed on Dec. 20, 2010, which is incorporated herein by reference in its entirety.

BACKGROUND

1. Technical Field

The present invention relates to a printing liquid container, a printing liquid filled container, an image forming apparatus, and a printing liquid filled container manufacturing method.

2. Background Art

An image forming apparatus, such as a printer, facsimile, copying machine, plotter or multi-function machine thereof, is known as an example of an image forming apparatus that employs a liquid droplet jetting recording method to jet a printing liquid, such as for example ink, as liquid droplets using a recording head.

There are examples of such an image forming apparatus that uses a liquid droplet jetting recording method, in which a liquid is supplied from a printing liquid container to a recording head and/or a main tank in communication with the recording head.

For example, in Japanese Patent Application Laid-Open (JP-A) No. 7-290717, an ink supply device is described in which a hole is pierced with a hole piercing tool in a sealing portion that seals an opening of a printing liquid container, and the ink supply device feeds ink from the printing liquid container to a recording head.

More specifically the sealing portion is configured as a thin film, and a hole is pierced in the sealing portion by first providing an ink hole in the sealing portion, then stretching the thin film with the hole piercing tool so as to expand the ink hole to enlarge and allow ink to flow out from the opening.

In JP-A No. 2007-38537 there is also a description of a sealing portion for sealing an opening of a printing liquid container formed with fine grooves, of either a cross shape or a radiating star shape, at a position where the leading end of a hole piercing tool makes initial contact, so as to smoothly pierce a hole in the sealing portion and to consistently achieve a specific shape for the ruptured shape of the sealing portion.

However, in the configuration of JP-A No. 7-290717, since the ink hole is provided in the sealing portion, the ink may drip out from the ink hole. Furthermore, since the ink hole is expanded by stretching the thin film with the hole piercing tool, the opening area in the sealing portion cannot be expanded to any greater than the size of the hole piercing tool.

Furthermore, in the configuration of JP-A No. 2007-38537, since fine grooves are formed at the position where the leading end of the hole piercing tool makes initial contact, the opening surface area of the sealing portion cannot be expanded greater than the size of the hole piercing tool. Furthermore, when the leading end of the hole piercing tool makes initial contact with the fine grooves, the fine grooves rupture prior to stress being transmitted to other positions of the sealing portion, and other positions on the sealing portion may not rupture. Consequently, the opening surface area in the sealing portion cannot be expanded.

SUMMARY

The present invention provides a printing liquid container, a printing liquid filled container, an image forming apparatus, and a printing liquid filled container manufacturing method capable of increasing the opening surface area in a sealing portion.

A printing liquid container according to a first aspect of the present invention includes: a container main body formed with an opening to fill a liquid for printing; a capping section connected to the opening; a sealing portion provided to the capping section to seal the opening; a contact portion formed at a central portion of the sealing portion and contacted by a hole piercing tool to pierce a hole in the sealing portion; and a first rupture portion configured thinner than the sealing portion and extending from the contact portion to an outer peripheral portion of the sealing portion.

According to the above aspect, stress may be concentrated at the contact portion by forming the contact portion at a central portion of the sealing portion such that the hole piercing tool makes contact with the contact portion when a hole is being pierced in the sealing portion. Accordingly, stress transmission is facilitated from the contact portion to the outer peripheral portion of the sealing portion at the first rupture portion that is thinner than the sealing portion. Consequently, the whole of the first rupture portion can be made to rupture, and the opening surface area of the sealing portion may be increased.

A second aspect of the present invention, in the first aspect, may further include: a rupture inducing guide portion formed at an outer periphery of the contact portion, configured thinner than the sealing portion, and connected to the first rupture portion to induce and guide rupturing of the first rupture portion.

According to the above aspect, stress concentrated at the contact portion may be transmitted to the rupture inducing guide portion formed at the outer periphery of the contact portion and configured thinner than the sealing portion, thereby rupturing the rupture inducing guide portion. Such rupturing of the rupture inducing guide portion may guided to cause rupturing of the first rupture portion connected to the rupture inducing guide portion.

Furthermore, due to the rupture inducing guide portion being formed at the outer periphery of the contact portion the hole piercing tool may be guided to the contact portion.

A third aspect of the present invention, in the above aspects, the contact portion may be indented from a front surface of the sealing portion and may protrude out from a rear face of the sealing portion.

According to the above aspect, misplacement relative to the hole piercing tool may be prevented due to the leading end of the hole piercing tool contacting the contact portion when inserted further in than the front surface of the sealing portion. Furthermore, due to the thickness achieved by the contact portion protruding out from the back face, the hole piercing tool does not just pass through the contact portion alone without affecting the rupturing portion.

A fourth aspect of the present invention, in the above aspects, a thickness of the first rupture portion may be configured thicker than a thickness of the rupture inducing guide portion.

According to the above aspect, stress that has been concentrated at the contact portion causes the rupture inducing guide portion to rupture before the first rupture portion ruptures, and rupturing of the first rupture portion may be reliably guided and induced.

A fifth aspect of the present invention, in the above aspects, a plurality of the first rupture portions may be provided as curving line shaped groove portions in the sealing portion when viewed in plan view.

According to the above aspect, due to the first rupture portions being configured as curved line shaped groove portions, the length of each of the first rupture portions can be made comparatively longer than, for example, when configured as a straight line shaped groove portion, enabling the rupture length to be increased and the size of the opening surface area in the sealing portion to be made larger. Furthermore, since there are plural lines of such first rupture portion formed as curved line groove portions the opening surface area in the sealing portion may be increased further.

A sixth aspect of the present invention, in the fifth aspect, the curving line shape may be an S-shape.

According to the above aspect the shape of the first rupture portion does not readily conform to the shape of a standard hole piercing tool, and liquid may be made to flow out from the opening since the first rupture portion is ruptured and opens the sealing portion even if the sealing portion adheres to the hole piercing tool.

A seventh aspect of the present invention, in the above aspects, may further include: a second rupture portion formed along an outer peripheral portion of the sealing portion, connected to the first rupture portion, and configured thinner than the sealing portion.

According to the above aspect, when a hole is pierced in the sealing portion by the hole piercing tool the second rupture portion connected to the first rupture portion is ruptured by the rupturing of the first rupture portion. Since the outer peripheral portion of the sealing portion is opened even when only some of the second rupture portion is ruptured, the contact resistance to the hole piercing tool when the hole piercing tool has passed through out from the sealing portion may be reduced, and the generation of sealing portion abrasion debris may be prevented.

An eighth aspect of the present invention, in the seventh aspect, a plurality of second rupture portions may be provided at specific separations from each other.

According to the above aspect, due to plural of the second rupture portions being provided, the contact resistance to the hole piercing tool may be reduced, and also, due to providing the plural second rupture portions with the specific separation between each other, there are locations at the outer peripheral portion of the sealing portion that do not rupture, namely joining portions may be left remaining between the sealing portion and the capping section, and so the sealing portion may be prevented from peeling away and falling off from the capping section.

A ninth aspect of the present invention, in the above aspects, the capping section may be plugged into the opening.

According to the above aspect, the configuration of the capping section may be simplified, and the capping section and the opening may be reliably fitted together without a complicated operation, such as operation requiring torque control for an ordinary screw cap.

A tenth aspect of the present invention, in the ninth aspect, the capping section may include a cylinder body and a hook portion that projects out from an outer peripheral wall of the cylinder body; and the hook portion may latch together with a latching portion formed to an inner peripheral wall of the opening.

According to the above aspect the capping section may be prevented from coming out from the opening due to liquid pressure.

An eleventh aspect of the present invention, in the tenth aspect, a space may be configured at an inner peripheral wall of the opening portion where the latching portion is formed, and the space may enable the leading end of the cylinder body to deform in a diameter-widening direction.

According to the above aspect, the leading end of the cylinder body deforms in the diameter-widening direction with increased internal pressure due to, for example, impact, making latching between the hook portion and the latching portion stronger. The capping section may accordingly be prevented from coming out from the opening.

A twelfth aspect of the present invention, in above aspects, may further include, a resilient sealing member provided further to the capping section opening side than the sealing portion, and formed with a slit.

According to the above aspect, when the container is set with the opening facing downwards for piercing a hole in the sealing portion by inserting the hole piercing tool into the capping section, the hole is pierced in the sealing member and the seal member opened after the slit in the resilient sealing member has been spread wider by the hole piercing tool. Furthermore, when the hole piercing tool is pulled out from the opened sealing portion, any liquid that has remained in the printing liquid container is stopped by the resilient sealing member, and the slit that was spread wider by the hole piercing tool narrows due to resilient force of the resilient sealing member after the hole piercing tool has been pulled out from the resilient sealing member. Accordingly any remaining liquid may be prevented from leaking out from the capping section.

A thirteenth aspect of the present invention is printing liquid filled container including, the printing liquid container according to any one of first to twelfth aspects, that has been filled with a liquid for printing.

A fourteenth aspect of the present invention is an image forming apparatus including: the printing liquid container according to any one of the first to the twelfth aspects; and the hole piercing tool to pierce a hole in the sealing portion, wherein the hole piercing tool is configured with a different shape from the shape of the first rupture portion.

According to the above aspect, since the first rupture portion is ruptured and the sealing portion opened even if the sealing portion adheres to the hole piercing tool due to the first rupture portion having a different shape to the shape of the hole piercing tool, liquid may be made to flow out from the opening.

A fifteenth aspect of the present invention is a printing liquid filled container manufacturing method including: providing a container body formed with an opening to fill a liquid for printing; filling the container body with the liquid for printing; and plugging into the opening the capping section employed in the printing liquid container according to any one of the first to eighth aspects.

According to this method, the capping section and the opening may be reliably fitted together without employing a complicated process, such as an operation requiring torque control required for an ordinary screw cap.

A sixteenth aspect of the present invention, in the fifteen aspect, the capping section may include a cylinder body and a hook portion that projects out from an outer peripheral wall of the cylinder body; and the hook portion may latch together with a latching portion formed at an inner peripheral wall of the opening.

A seventeenth aspect of the present invention, in the sixteenth aspect, a space may be configured at an inner peripheral wall of the opening portion where the latching portion is formed and the space may enable the leading end of the cylinder body to deform in a diameter-widening direction.

An eighteenth aspect of the present invention, in the above aspects, the capping section may include a resilient sealing member that is provided further to the capping section opening side than the sealing portion, and a slit may be formed in the resilient sealing member.

According to the above aspects, the present invention may provide a printing liquid container, printing liquid filled container, image forming apparatus, and printing liquid filled container manufacturing method capable of increasing the opening surface area in a sealing portion.

BRIEF DESCRIPTION OF DRAWINGS

Exemplary embodiments of the present invention will be described in detail based on the following figures, wherein.

DETAILED DESCRIPTION

[First Exemplary Embodiment]

Figure 1:
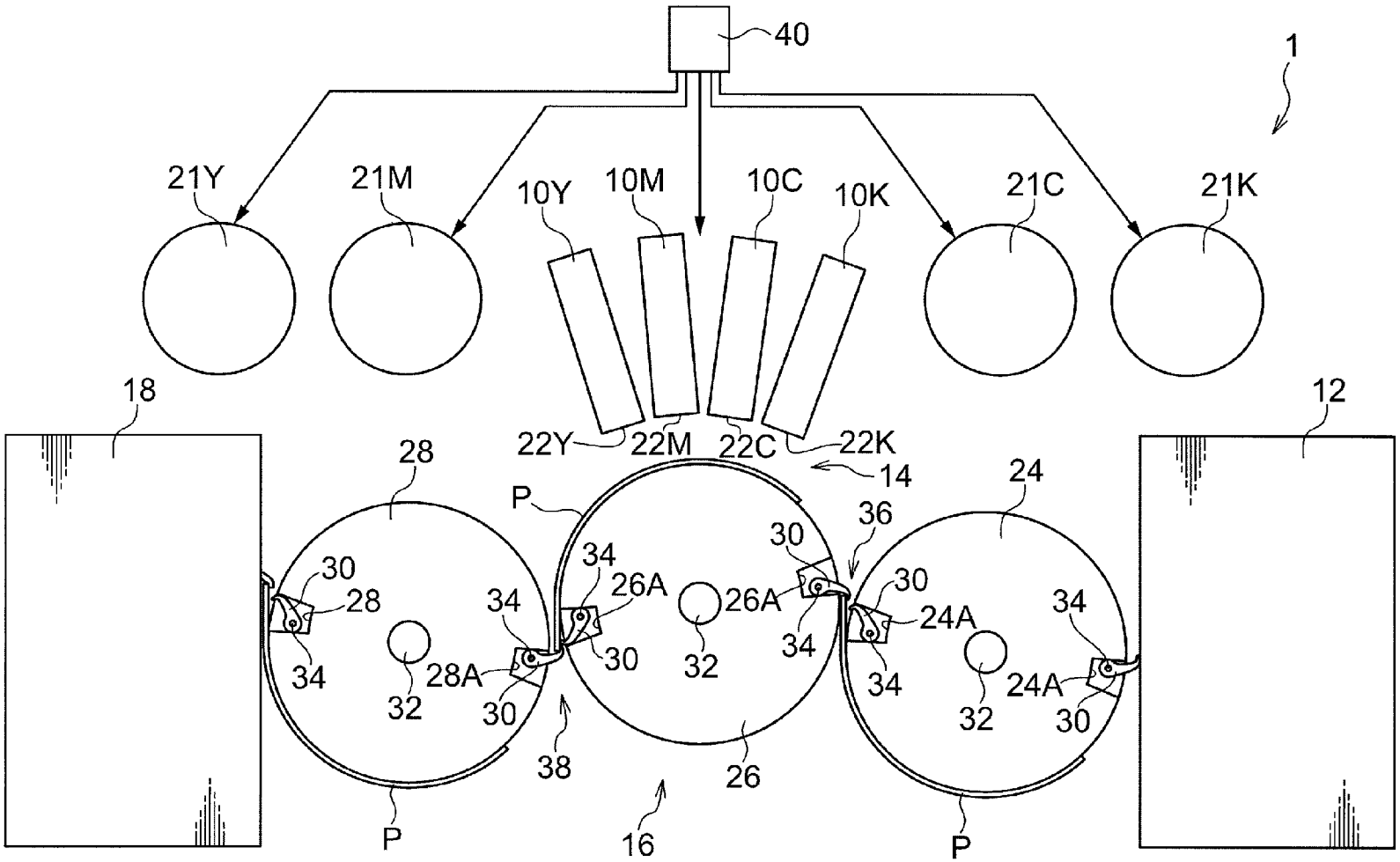
FIG. 1 is a schematic diagram illustrating an overall configuration of an inkjet recording apparatus including a printing liquid container according to an exemplary embodiment of the present invention.

Hereinafter, explanation will be described regarding a printing liquid container and an image forming apparatus according to a first exemplary embodiment of the present invention, with reference to the drawings. In the drawings members (configuration elements) having the same or corresponding function are allocated the same reference numerals and further explanation thereof is omitted.

Overall Configuration

FIG. 1 is a schematic diagram illustrating an overall configuration of an inkjet recording apparatus including a printing liquid container according to an exemplary embodiment of the present invention.

As shown in FIG. 1, an inkjet recording apparatus 1 includes: a recording medium housing section 12 that houses a recording medium P, such as paper; an image recording section 14 that records an image on the recording medium P; a conveying means 16 for conveying the recording medium P from the recording medium housing section 12 to the image recording section 14; and a recording medium discharge section 18 that discharges the recording medium P that has been recorded with an image in the image recording section 14.

The image recording section 14 includes liquid droplet jetting devices (referred to below as "inkjet heads") 10Y, 10M, 10C, 10K, serving as examples of a liquid droplet jetting head that jets liquid droplets, that jet ink droplets onto a recording medium to record an image. In the following the inkjet heads 10Y, 10M, 10C, 10K will be referred to below collectively as "inkjet heads 10Y to 10K".

The inkjet heads 10Y to 10K have respective nozzle faces 22Y to 22K formed with nozzles (not shown in the drawings). The nozzle faces 22Y to 22K have a recordable region that is of about the same size as, or greater than, the maximum width of the recording medium P anticipated to be image-recorded with the inkjet recording apparatus 1.

The inkjet heads 10Y to 10K are disposed next to each other in a row in the color sequence yellow (Y), magenta (M), cyan (C) and black (K), as listed from the recording medium P conveying direction downstream side. Configuration is made such that ink droplets of the respective corresponding color are jetted using a piezoelectric method from plural nozzles to record an image. A configuration using any other jetting method, such as a thermal jetting method, may be employed in the inkjet heads 10Y to 10K as a configuration for jetting ink droplets.

Main ink tanks 21Y, 21M, 21C, 21K (referred to below as main ink tanks 21Y to 21K) store ink of each of the colors, and are provided as storage sections that store liquid in the inkjet recording apparatus 1. Ink is fed from the main ink tanks 21Y to 21K to each of the respective inkjet heads 10Y to 10K. Note that various types of ink may be applied as the ink for feeding to the inkjet heads 10Y to 10K, such as water based inks, oil based inks and solvent based inks The conveying means 16 includes: a take-out drum 24 that takes out the recording medium P inside the recording medium housing section 12 one sheet at a time; a conveying drum 26 that conveys the recording medium P to the inkjet heads 10Y to 10K of the image recording section 14 and makes the recording face (front face) of the recording medium P face towards the inkjet heads 10Y to 10K; a feed-out drum 28 that feeds out to the recording medium discharge section 18 the image-recorded recording medium P. The take-out drum 24, the conveying drum 26 and the feed-out drum 28 are each configured to retain the recording medium P on their peripheral faces by employing an electrostatic attraction means and/or a non-electrostatic attraction manse such as by using suction or adhesive.

The take-out drum 24, the conveying drum 26 and the feed-out drum 28 each have clippers 30 serving as retaining means that retain the recording medium P by nipping a portion on the recording medium P conveying direction downstream edge. For example, the three drums 24, 26, 28 are provided with two sets of the clippers 30 each, and are configured to retain two sheets of recording medium P on their respective peripheral faces using the clippers 30. The clippers 30 are provided inside two concave portions 24A, 26A, 28A formed in the peripheral face of each of the drums 24, 26, 28.

More specifically, rotation shafts 34 are supported at predetermined positions in the concave portions 24A, 26A, 28A of each of the drums 24, 26, 28 to align with the rotation axis 32 of each of the drums 24, 26, 28, and the plural clippers 30 are fixed to the rotation shafts 34 at intervals along the axial direction. Consequently, when the rotation shafts 34 are rotated in a forward or reverse direction by actuators (not shown in the drawings), the clippers 30 are also rotated in the forward or reverse direction along the circumferential direction of each of the drums 24, 26, 28 to either nip or release portions at the recording medium P conveying direction downstream edge.

Namely, by rotating the clippers 30, the leading end portions of the clippers 30 slightly project out from the peripheral faces of the drums 24, 26, 28, and the recording medium P is passed across from the clippers 30 of the take-out drum 24 to the clippers 30 of the conveying drum 26 at a passing-across position 36 where the peripheral face of the take-out drum 24 and the peripheral face of the conveying drum 26 face each other. Similarly, the recording medium P is passed across from the clippers 30 of the conveying drum 26 to the clippers 30 of the feed-out drum 28 at a passing position 38, where the peripheral face of the conveying drum 26 and the peripheral face of the feed-out drum 28 face each other.

The inkjet recording apparatus 1 is provided with a maintenance unit (not shown in the drawings) for maintaining the inkjet heads 10Y to 10K. The maintenance unit has various configuration elements such as a cap that covers the nozzle faces of the inkjet heads 10Y to 10K, a receiving member that receive liquid droplets jetted in preparation (dummy jetting), a cleaning member that cleans the nozzle faces, and a suction device for suctioning ink inside the nozzles. The maintenance unit performs various types of maintenance operation by moving to a position facing towards the inkjet heads 10Y to 10K. The maintenance unit is supplied with a cleaning fluid.

Explanation follows regarding image recording operation of the inkjet recording apparatus 1.

The recording medium P, taken out one sheet at a time from the recording medium housing section 12 and retained using the clippers 30 of the take-out drum 24, is conveyed while adhered to the peripheral face of the take-out drum 24. Then, the recording medium P is passed across from the clippers 30 of the take-out drum 24 to the clippers 30 of the conveying drum 26 at the passing-across position 36.

The recording medium P now retained by the clippers 30 of the conveying drum 26 is then conveyed while adhered to the conveying drum 26 to the image recording position of each of the inkjet heads 10Y to 10K, and an image is recorded on the recording face of the recording medium P by ink droplets jetted from the respective inkjet heads 10Y to 10K.

The recording medium P that has been recorded with an image on the recording face is passed across from the clippers 30 of the conveying drum 26 to the clippers 30 of the feed-out drum 28 at the passing position 38. The recording medium P now retained by the clippers 30 of the feed-out drum 28 is then conveyed while adhered to the feed-out drum 28 and discharged into the recording medium discharge section 18. The above completes one cycle of image recording operations.

The main ink tanks 21Y to 21K are connected to a liquid supply device 40. The liquid supply device 40 supplies ink or cleaning fluid respectively to the main ink tanks 21Y to 21K or the maintenance unit.

Liquid Supply Device

Figure 2:
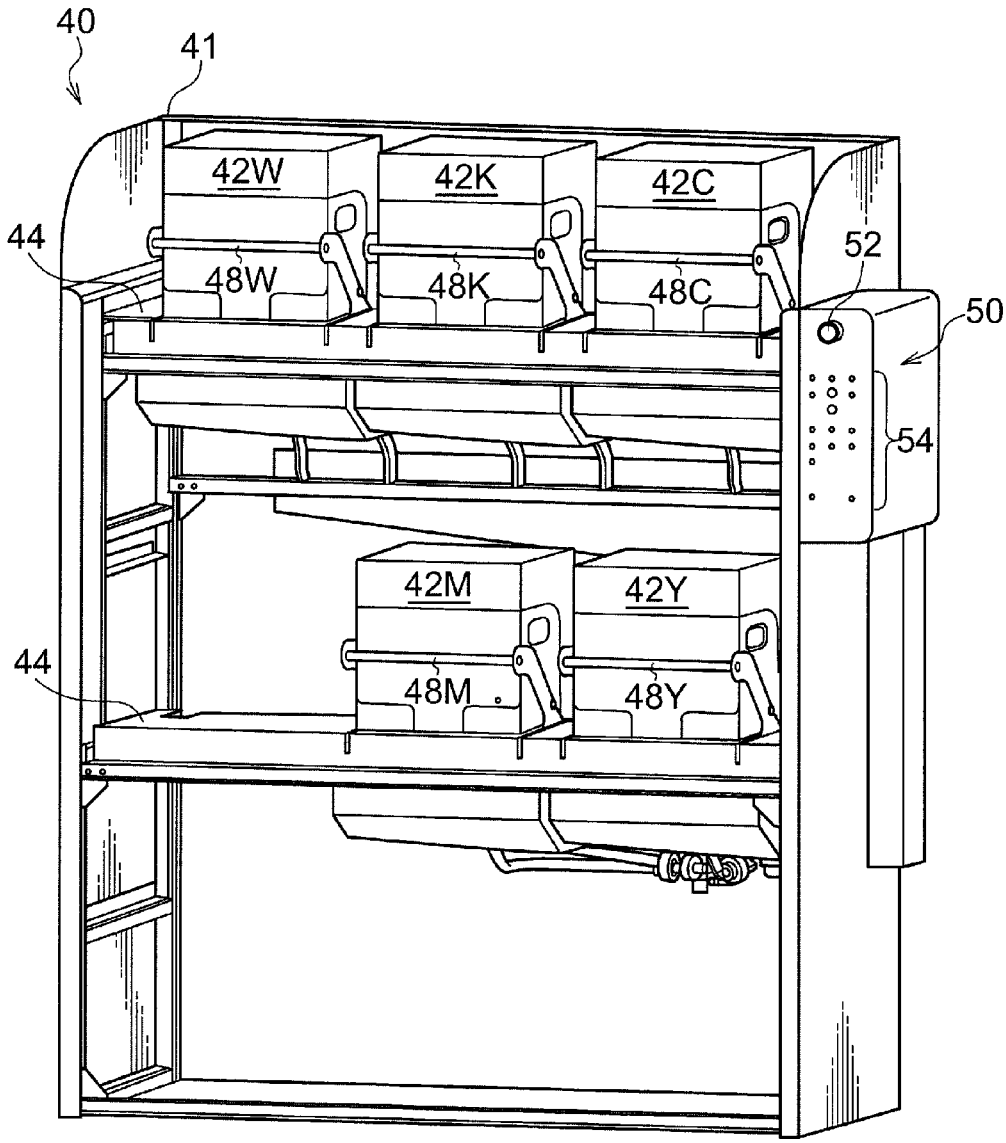
FIG. 2 is an overall perspective view illustrating a liquid supply device.

FIG. 2 is a perspective view illustrating an overall configuration of the liquid supply device 40.

The liquid supply device 40 is configured with a three-shelved casing body 41, and with five individual tank units 42Y, 42M, 42C, 42K, 42W provided to the casing body 41. The tank units 42Y, 42M, 42C, 42K, 42W are referred to as "tank units 42Y to 42W". The tank units 42Y to 42W are each formed as a substantially rectangular block shaped body.

The tank units 42Y, 42M, 42C, 42K are filled with yellow, magenta, cyan and black inks respectively, and the tank unit 42W is filled with a cleaning fluid. The tank units 42Y to 42W are attached to the casing body 41 to be detachable from seating sections 44, and configure replaceable supply tanks for feeding liquid to their respective destinations.

Figure 4:
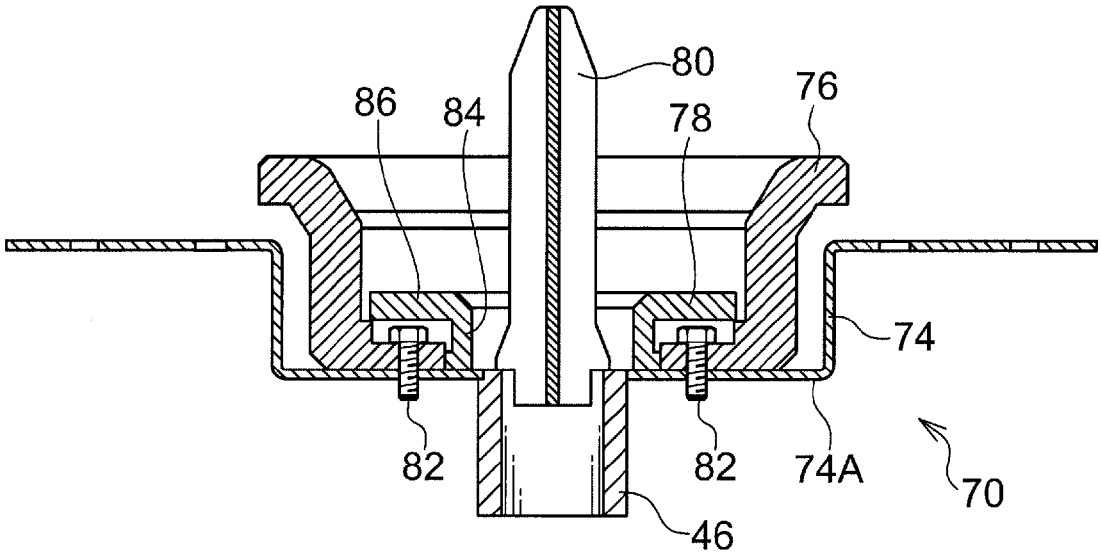
FIG. 4 is a cross-sectional view illustrating a configuration of a hole piercing section.

The tank unit 42Y and the tank unit 42M are provided at the seating section 44 on the middle tier of the casing body 41. The tank unit 42C, the tank unit 42K and the tank unit 42W are provided at seating section 44 on the upper tier of the casing body 41. Distribution tubes 46 (not shown in the FIG. 1. Refer to FIG. 4) correspondingly connect together: the tank unit 42Y to the main ink tank 21Y; the tank unit 42M to the main ink tank 21M; the tank unit 42C to the main ink tank 21C; the tank unit 42K to the main ink tank 21K; and the tank unit 42W to the maintenance unit.

Each of the tank units 42Y to 42W are provided higher than their respective connection destinations (feed destinations), the main ink tanks 21Y to 21K or the maintenance unit. Ink or cleaning fluid is fed to the connection destination by using the header difference.

Operation levers 48Y, 48M, 48C, 48K, 48W are provided to the seating sections 44 of the casing body 41 so as to correspond to the tank units 42Y to 42W. The operation levers 48Y, 48M, 48C, 48K, 48W are manipulated up or down by the operator in order to replace the tank units 42Y to 42W.

An operation panel 50 is attached to the casing body 41 near the upper right hand side. The operation panel 50 is equipped with an operation switch 52 and plural display lights 54. The corresponding display light 54 is illuminated whenever the ink in any of the main ink tanks 21Y to 21K or the cleaning fluid in the maintenance unit has decreased to a predetermined level, thereby prompting an operator to replace the corresponding tank unit(s) 42Y to 42W.

Since the configuration of each of the tank units 42Y to 42W is similar to each other, and the configuration of each of the operation levers 48Y to 48W is similar to each other, specific explanation will be given regarding one of each, the tank unit 42Y and the operation lever 48Y. Note that the suffix "Y" is omitted.

Figure 3A:
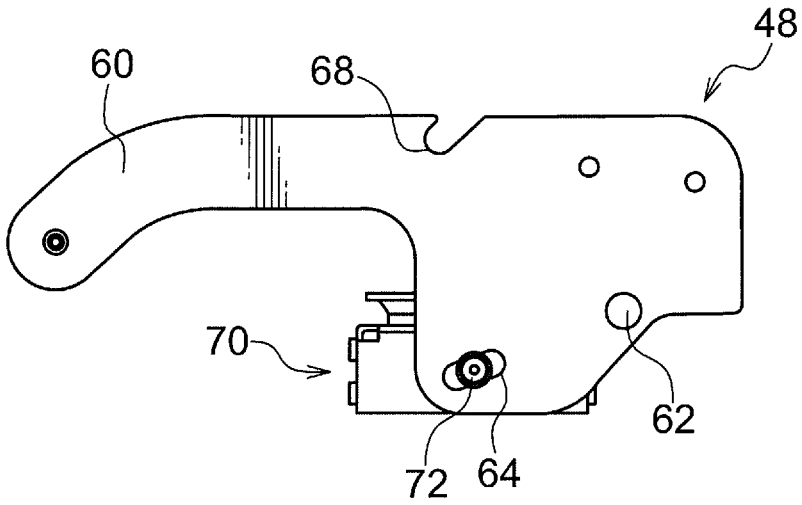
FIG. 3A is a side view illustrating the interior of the seating section shown in FIG. 2, and focusing on an operation lever in a lowered position.
Figure 3B:
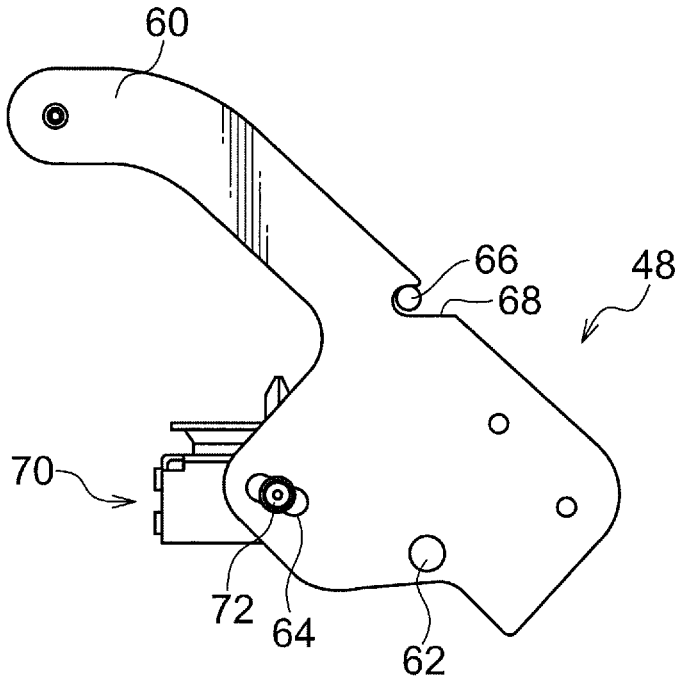
FIG. 3B is a side view illustrating the interior of the seating section shown in FIG. 2, and focusing on an operation lever in a raised position.

FIG. 3A and FIG. 3B are side views illustrating the interior of the seating section 44 shown in FIG. 2, and focusing on the operation lever 48. The operation lever 48 is shown in the lowered position in FIG. 3A and the operation lever 48 is shown in the raised position in FIG. 3B.

The operation lever 48 has two lever arms 60 (one is not shown in the drawings). Each of the lever arms 60 is supported by the seating section 44 through a rotation shaft 62, with the operation lever 48 capable of rotational operation about the rotation shaft 62. Each of the lever arms 60 is formed with an elongated hole 64 and a cutout groove 68 for engaging with an engaging pin 66, described later. The cutout groove 68 is formed along a circular circumference centered on the rotation shaft 62, and is configured to prevent the tank unit 42 from being removed while the cutout groove 68 is in an engaged state with the engaging pin 66.

A hole piercing section 70 disposed in a position in the seating sections 44 facing the tank unit 42 are connected to the operation lever 48. The hole piercing section 70 is operated up or down according to the operation position of the operation lever 48. Specifically, the hole piercing section 70 is disposed between the lever arms 60, with side end pins 72 that are provided on both side faces of the hole piercing section 70 connected to the operation lever 48 to fit into the elongated hole 64 formed on each of the lever arms 60. Rotational operation of the operation lever 48 causes the hole piercing section 70 to be moved up or down along two portal shaped guide members (not shown in the drawings), provided on the side faces of the hole piercing section 70.

As described below, the hole piercing section 70 is fitted into (inserted into) the tank unit 42 when the operation lever 48 is operated upwards, and sealing of the tank unit 42 is broken by the hole piercing section 70 enabling liquid (ink) to be discharged from the tank unit 42.

FIG. 4 is a cross-sectional view illustrating a configuration of the hole piercing section 70.

The hole piercing section 70 is configured with a base member 74, opening towards the top from a recess 74A provided to the base member 74, a surrounding member 76 provided to surround the opening, a receiving member 78 provided inside the surrounding member 76, and a hole piercing tool 80 disposed inside the receiving member 78.

The surrounding member 76 is fixed to the base member 74 by screws 82. A hole is pre-provided in the center of the bottom face of the surrounding member 76. A hole having a size smaller than the hole in the surrounding member 76 is also pre-provided in the center of the bottom face of the recess 74A of the base member 74.

The receiving member 78 is formed from a rubber material in a substantially cylindrical shape, equipped with a cylinder portion 84 and a receiving portion 86 extending towards the outside from one end of the cylinder portion 84. The other end of the cylinder portion 84 is placed in close contact with the bottom of the recess 74A of the base member 74 and the receiving portion 86 is also placed in close contact with the bottom of the surrounding member 76. The hole formed by the recess 74A of the base member 74 is connected to one end of the distribution tube 46 for connection to the liquid feed destination. The base portion of the hole piercing tool 80 is attached to the end face of the distribution tubes 46, thereby fixing the hole piercing tool 80 with the leading end portion of the hole piercing tool 80 facing upward.

Figure 5A:
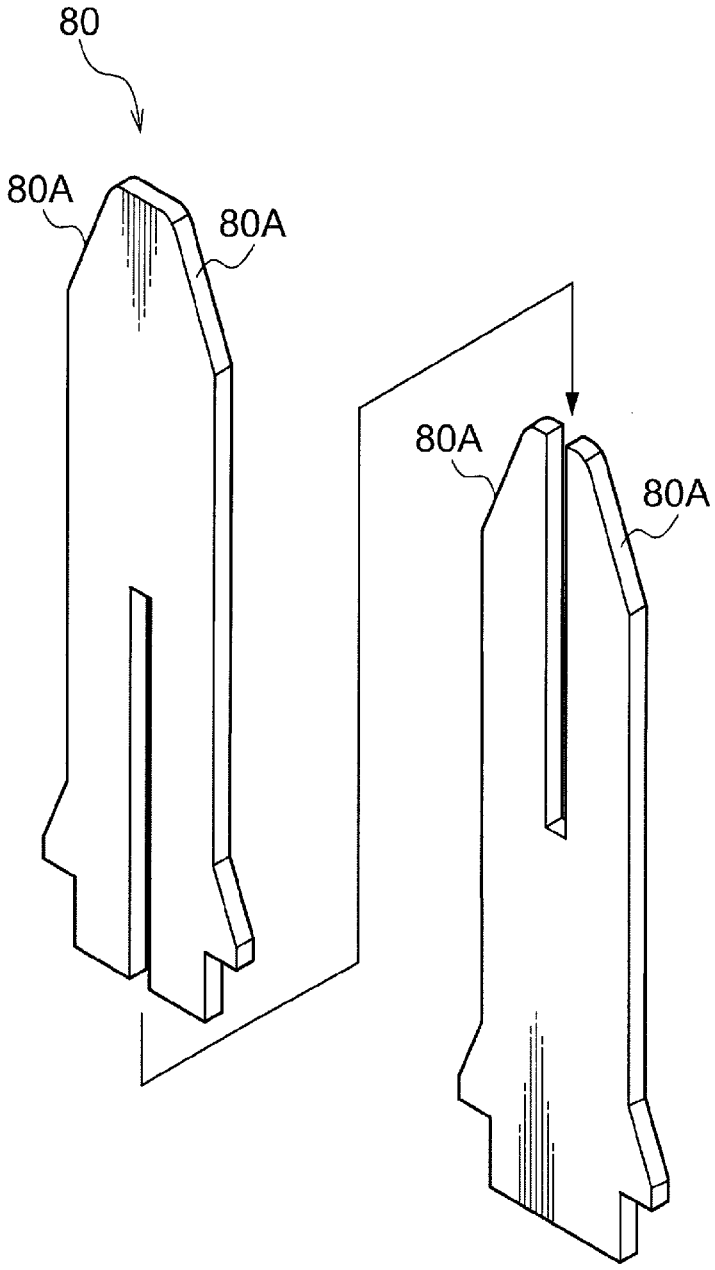
FIG. 5A is an exploded diagram of the hole piercing tool.
Figure 5B:
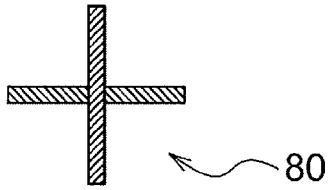
FIG. 5B is a cross-sectional view of the hole piercing tool.

FIG. 5A and FIG. 5B are configuration diagrams illustrating a specific configuration of the hole piercing tool 80. FIG. 5A is an exploded diagram of the hole piercing tool 80, and FIG. 5B is a cross-sectional view of the hole piercing tool 80.

The hole piercing tool 80 is configured by assembling two plates at right angles to each other. Specifically, one plate out of the two plates has a groove extending from the base end side, and the other plate has a groove extending from the leading end side. The hole piercing tool 80 is formed by assembling the plates such that one plate is inserted into the groove of the other. After assembling the plates together, they are fixed by welding or adhesive. As shown in FIG. 5A and FIG. 5B, sloping portions 80A are formed at the leading end side of the hole piercing tool 80 to slope towards the leading end center, with the hole piercing tool 80 exhibiting a radiating shape in cross-section, or more specifically a cross shape. Namely, overall the hole piercing tool 80 exhibits a cross shaped needle.

The hole piercing tool 80 is inserted into the tank unit 42 by the hole piercing section 70 being moved upwards by operating the operation lever 48.

Figure 6C:
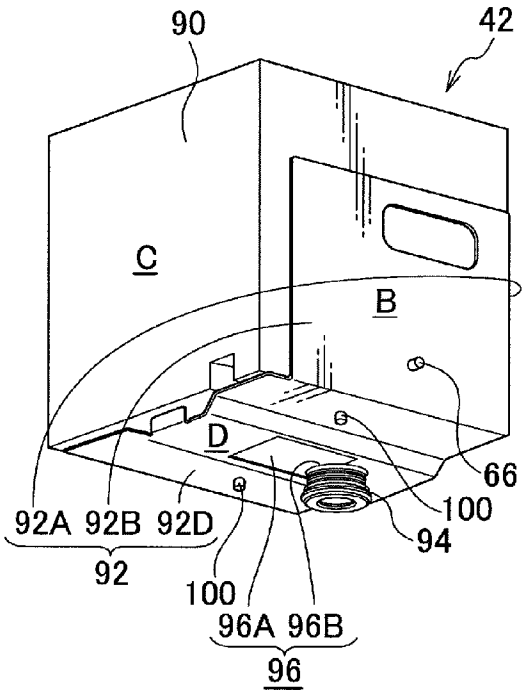
FIG. 6A to FIG. 6C are perspective views of a tank unit as seen from three directions of changed angle.
Figure 6B:
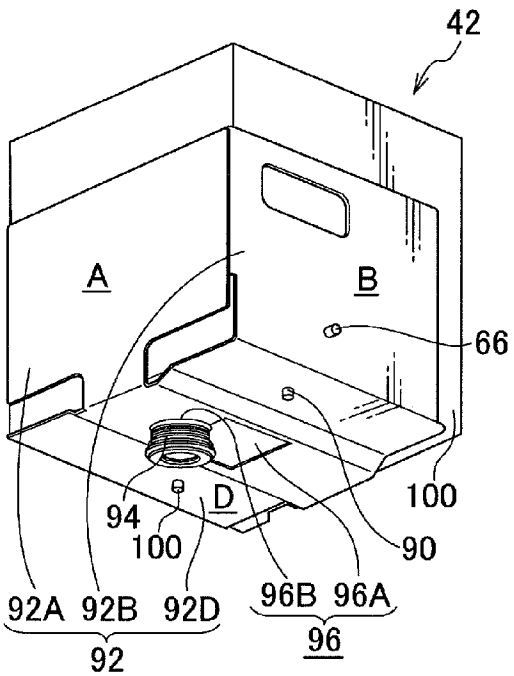
Figure 6A:
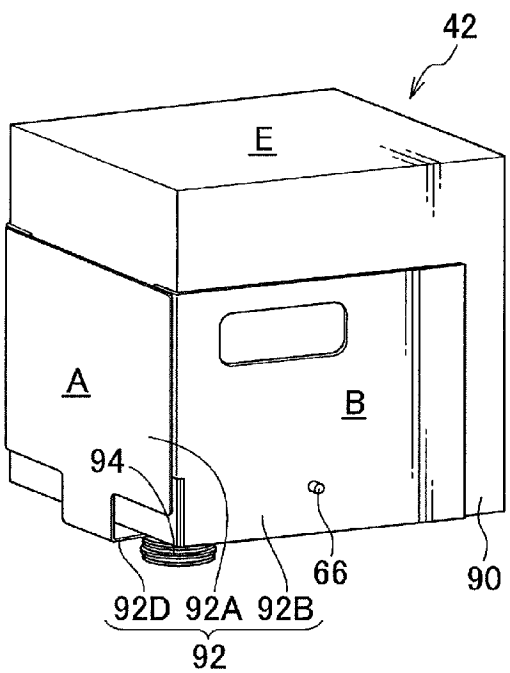

FIG. 6A to FIG. 6C are perspective views illustrating the tank unit 42. FIG. 6A, FIG. 6B and FIG. 6C each illustrate the tank unit 42 as viewed from 3 directions at changed angles.

The tank unit 42 is configured with a carton unit 90 and a carton adaptor 92 for installing the carton unit 90. In the drawings, the face that faces the front when the tank unit is installed in the seating section (front face) is denoted A, B denotes side faces, C denotes the back face, D denotes the bottom face, and E denotes the top face. A capping section 94 projects out from the bottom face D and becomes a liquid inlet-outlet.

The carton adaptor 92 is formed from thin sheet metal to configure a mutually orthogonal front plate 92A, side plates 92B and bottom plate 92D that surround four faces out of the six faces of the carton unit 90, the front face, both side faces and the bottom face.

An opening section 96 is formed to the bottom plate 92D to let the capping section 94 of the carton unit 90 pass through. The opening section 96 is configured with a rectangular shaped open portion (referred to below as a "rectangular opening portion") 96A and a semi-circular shaped opening portion (referred to below as a "semi-circular opening portion") 96B. The rectangular opening portion 96A is formed with a larger lateral cross-section than the capping section 94 and is a portion that allows the capping section 94 to pass through. The semi-circular opening portion 96B is formed with a lateral cross-section that is smaller than that of the capping section 94, and is a portion that hooks onto the capping section 94 that has passed through from the rectangular opening portion 96A, retaining the capping section 94 not to come out from the opening section 96.

Two individual positioning pins 100 are formed to the bottom plate 92D, with a slight rounding applied to the leading ends of the positioning pins 100 that face outwards. The positioning pins 100 are designed to position each of the tank units 42 when mounting the tank units 42 to the seating sections 44.

One of the outward facing engaging pins 66 is formed to each of the two side plates 92B. As mentioned above, the engaging pins 66 are configured to engage with the cutout grooves 68 of the lever arms 60, when the operation lever 48 has been operated to the raised position.

Explanation follows regarding the carton unit 90 installed to the carton adaptor 92 as described above.

Carton Unit

Figure 7:
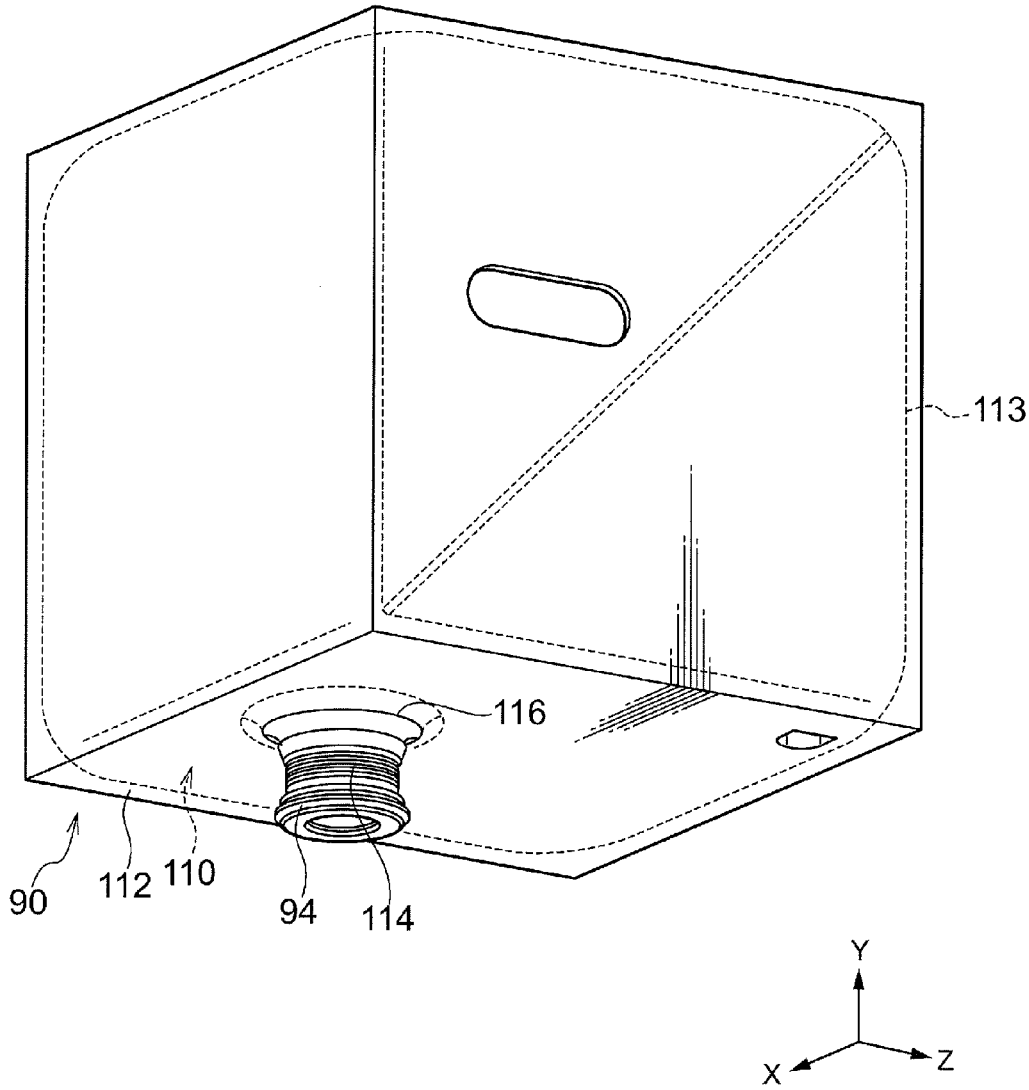
FIG. 7 is a perspective view illustrating a configuration of a carton unit.

FIG. 7 is a perspective view illustrating a configuration of the carton unit 90.

The carton unit 90 is formed in a substantially rectangular block shape. The carton unit 90 is configured with a printing liquid container 110 according to the first exemplary embodiment of the present invention, and a carton (paper box) 112 for housing a liquid pack 113 of the printing liquid container 110.

The printing liquid container 110 according to the first exemplary embodiment of the present invention is provided with the liquid pack 113 and the capping section 94. The liquid pack 113 is flexible and is formed in a substantially rectangular box shape, for example from polyethylene, and contains a liquid (ink). An opening 114 is formed to the liquid pack 113 for use when filling with liquid. The capping section 94 is connected to the opening 114, and an opening 116 is provided in the carton 112 to expose the capping section 94. When installing the liquid pack 113 housed in the carton 112 to the carton adaptor 92 it is easier to handle the liquid pack 113 in a housed state in the carton 112 than handling the liquid pack 113 alone, thereby facilitating installation of the liquid pack 113 to the carton adaptor 92.

There are no air holes provided in the liquid pack 113 other than the capping section 94, resulting in a configuration such that the liquid pack 113 collapses as liquid is discharged.

Figure 8:
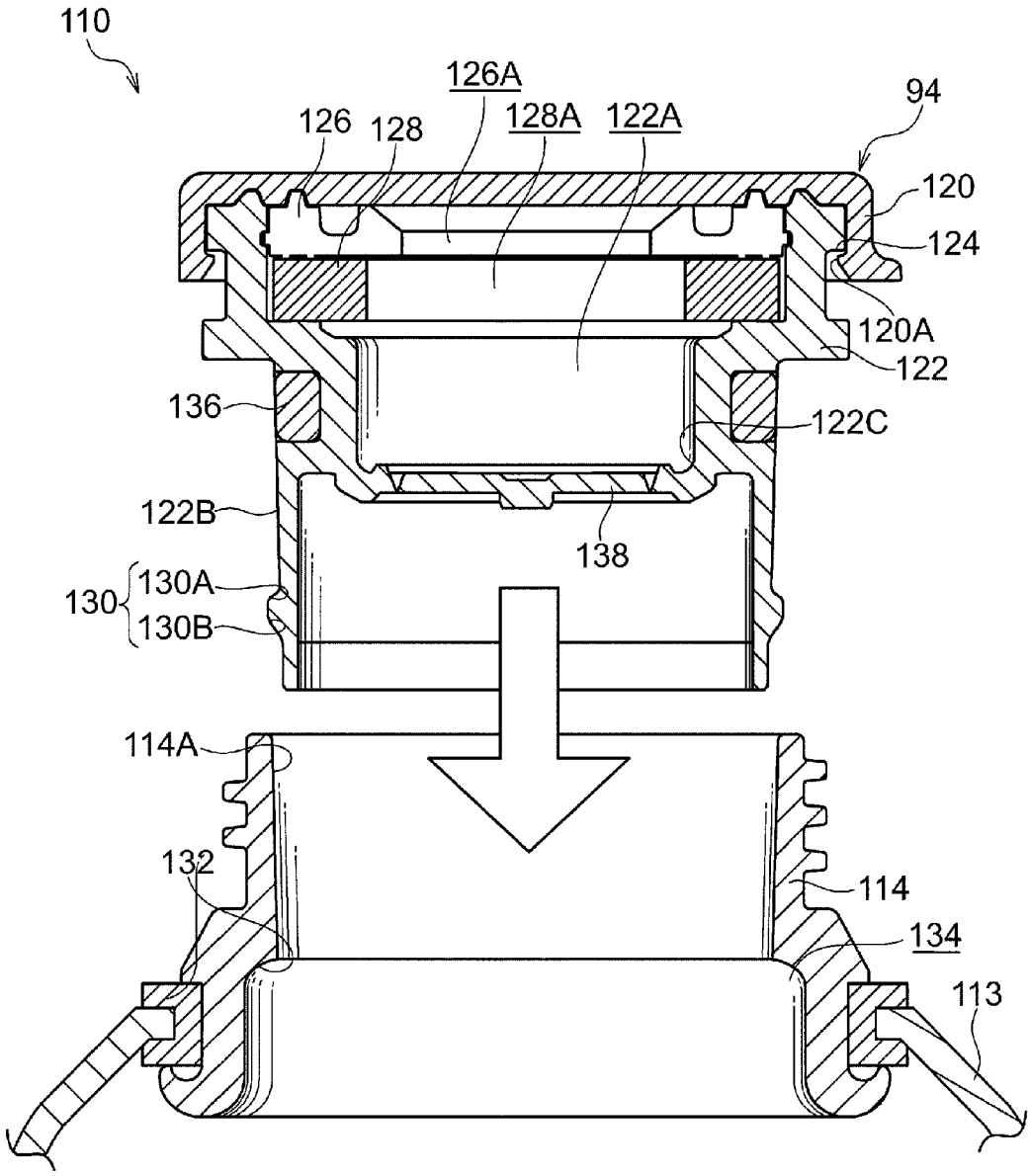
FIG. 8 is a cross-section illustrating a configuration of a capping section of a printing liquid container according to a first exemplary embodiment of the present invention, with the capping section shown in a state prior to being connected (plugging into) an opening.
Figure 9:
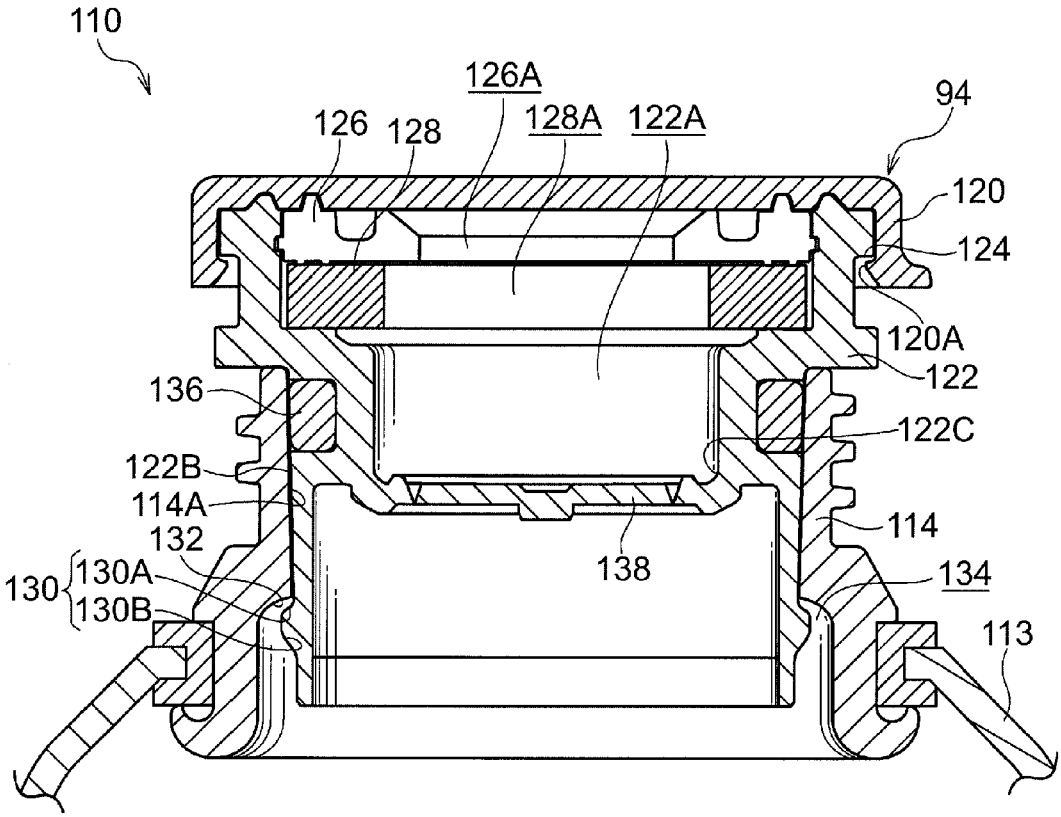
FIG. 9 is a cross-section illustrating a configuration of the capping section, with the capping section shown in a connected (plugged in) state to the opening.

FIG. 8 is a cross-sectional view illustrating a configuration of the capping section 94 of the printing liquid container 110 according to the first exemplary embodiment of the present invention. FIG. 8 illustrates a state prior to connecting (plugging) the capping section 94 to (into) the opening 114. FIG. 9 is a cross-sectional view illustrating a configuration of the capping section 94, illustrating the capping section 94 in a state after connecting to (plugging into) the opening 114.

The capping section 94 is plugged into and connected to the opening 114 of the ink-filled liquid pack 113. The capping section 94 is formed from a resin material, and includes a dust-prevention cap 120 and a cap main body 122.

The dust-prevention cap 120 is attached to the outside of the leading end of the cap main body 122, and is provided to prevent dust from entering into the cap main body 122 during transporting and/or storing the carton unit 90. The dust-prevention cap 120 is accordingly removed from the cap main body 122 when the carton unit 90 is to be used. The dust-prevention cap 120 includes a hook portion 120A, and the dust-prevention cap 120 is suppressed from falling off from the cap main body 122 by the hook portion 120A latching onto a latching portion 124 formed to the cap main body 122.

Between an inner wall of the dust-prevention cap 120 and an inner peripheral wall 122C of the cap main body 122 are provided a press plate 126 to press against the dust-prevention cap 120, and a support plate 128 to support the dust-prevention cap 120.

The press plate 126 is formed with a circular cylindrical shaped through hole 126A passing through a central portion of the press plate 126. The support plate 128 is supported on at inner peripheral wall 122C of the cap main body 122, and, similarly to the press plate 126, a circular cylindrical shaped opening 128A is formed passing through a central portion of the support plate 128 to communicate with the through hole 126A.

Similarly, a circular cylindrical shaped through hole 122A is formed passing through a central portion of the cap main body 122. A hook portion 130 projects out from an outer peripheral wall 122B of a leading end portion at the inside (the liquid pack 113 side) of the cap main body 122. When the cap main body 122 has been plugged into the opening 114 of the liquid pack 113, the hook portion 130 latches onto a latching portion 132 formed to an inner peripheral wall 114A of the opening 114. The hook portion 130 is equipped with a first beveled portion 130A and a second beveled portion 130B. The second beveled portion 130B has a more obtuse angle of bevel (more gentle bevel) than the first beveled portion 130A, facilitating plugging the cap main body 122 into the opening 114. In contrast, the first beveled portion 130A has a more acute angle of bevel (more abrupt bevel) than the second beveled portion 130B, making it more difficult for the cap main body 122 to come out from the opening 114.

Note that a space 134 is formed between the outer peripheral wall 122B at the inside leading end portion of the cap main body 122 and the inner peripheral wall 114A of the opening 114 formed with the latching portion 132. The space 134 allows the inside leading end portion of the cap main body 122 to deform in the diameter-widening direction.

An O-ring 136 is also mounted to the outer peripheral wall 122B of the cap main body 122. The O-ring 136 prevents liquid from leaking from any gap formed between the cap main body 122 and the opening 114 when the cap main body 122 has been plugged into the opening 114.

A sealing membrane 138 is provided at a central portion of the inner peripheral wall 122C of the cap main body 122 for closing off the through hole 122A and sealing the opening 114.

Figure 10:
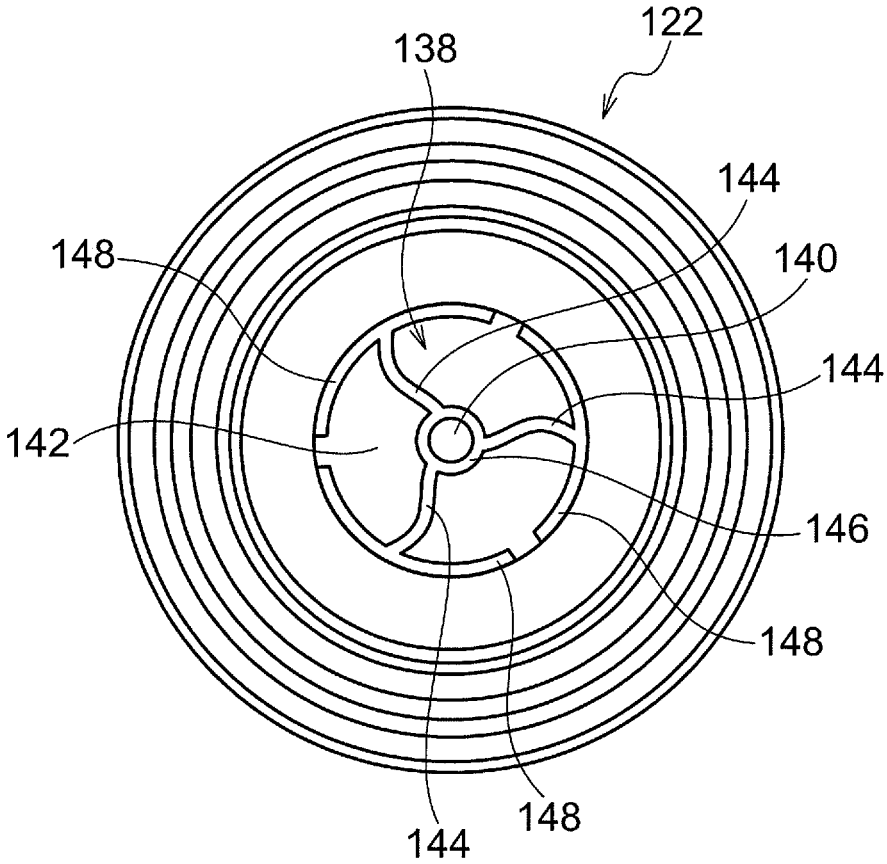
FIG. 10 is a plan view of a cap main body (a diagram as seen from the opening side of the cap main body)

FIG. 10 is a plan view of the cap main body 122 (as viewed from the cap main body 122 opening side).

The sealing membrane 138 provided to the cap main body 122 is circular shaped when viewed in plan view, with a diameter formed to be larger than the width direction length of the hole piercing tool 80. The sealing membrane 138 is mainly configured with: a plan-view circular shaped contact portion 140 formed at a central portion of the sealing membrane 138 where the leading end of the hole piercing tool 80 makes contact; a surround portion 142 surrounding the outer periphery of the contact portion 140 and joined to the cap main body 122; and first rupture portions 144 thinner than the contact portion 140 and the surround portion 142 and cutting across the surround portion 142 to extend out from the contact portion 140 to the outer peripheral portion of the sealing membrane 138.

The contact portion 140 is indented from the front face of the surround portion 142 and protrudes out from the back face.

The shape of the first rupture portions 144 is formed to be a different shape from the hole piercing tool 80 shape. In the first exemplary embodiment, the first rupture portions 144 are configured with 3 radiating lines, each formed as a substantially S-shaped curved line shaped groove portion in the sealing membrane 138 when viewed in plan view.

A rupture inducing guide portion 146 is formed in the sealing membrane 138 connected to the first rupture portions 144 at one end. The rupture inducing guide portion 146 is formed between the contact portion 140 and the surround portion 142, and is connected to both the contact portion 140 and the surround portion 142. The rupture inducing guide portion 146 is thinner than the contact portion 140 and the surround portion 142, and induces and guides rupturing to the first rupture portions 144. The rupture inducing guide portion 146 is configured by a plan-view ring shaped groove portion in the sealing membrane 138. Namely, the contact portion 140 projects out upwards (towards the cap main body 122 open side) from the groove portion formed at the outer periphery of the contact portion 140. The thickness of the first rupture portions 144 is similar to the thickness of the rupture inducing guide portion 146.

Second rupture portions 148 are connected to the other ends of the first rupture portions 144. The second rupture portions 148 are formed along the outer peripheral portion of the sealing membrane 138, and are thinner than the contact portion 140 and the surround portion 142. The second rupture portions 148 are disposed at specific intervals from each other, and when viewed in plan view, together configure a substantially ring shaped groove portion in the sealing membrane 138.

Operation

Explanation follows regarding operation of the printing liquid container 110 according to the first exemplary embodiment of the present invention.

Figure 11A:
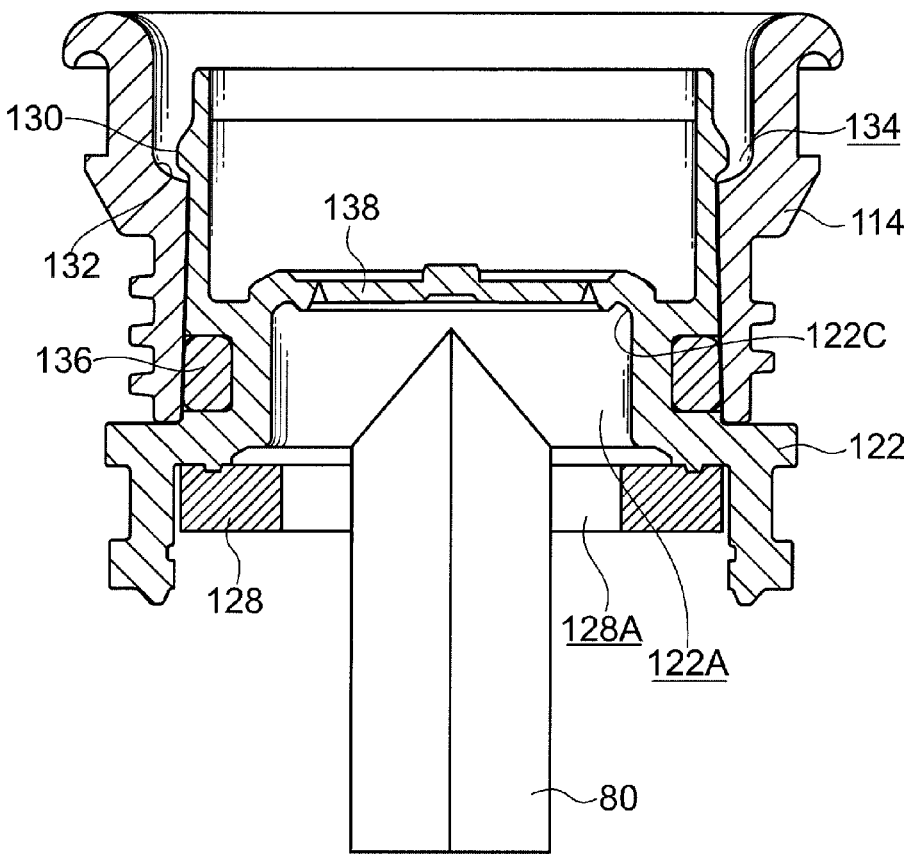
FIG. 11A is an explanatory diagram illustrating a state prior to a hole piercing tool piercing a hole in a seal membrane in a printing liquid container according to the first exemplary embodiment of the present invention.
Figure 11B:
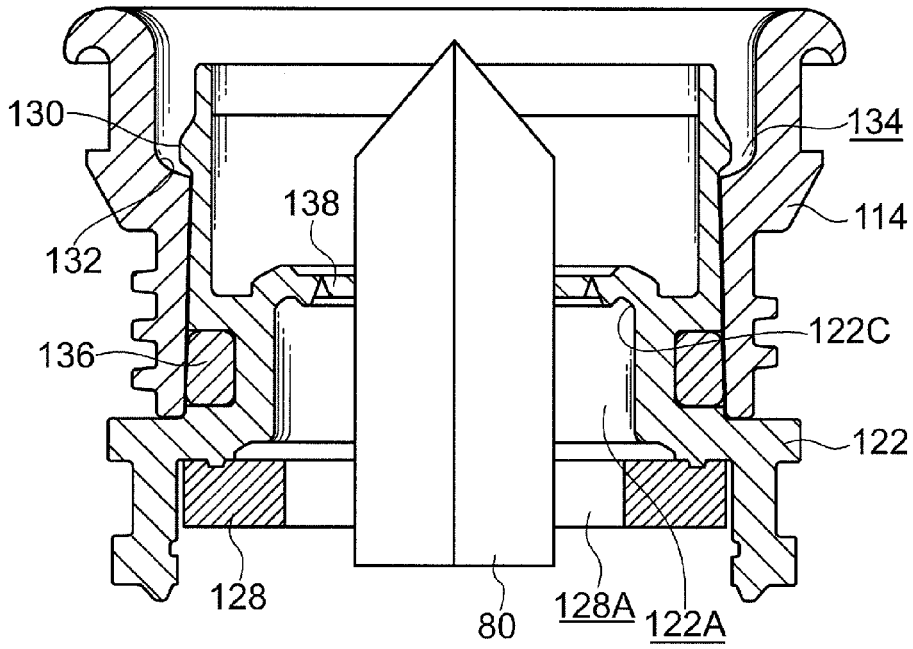
FIG. 11B is an explanatory diagram illustrating a state after a hole has been pierced in a printing liquid container according to the first exemplary embodiment of the present invention.

FIG. 11A and 11B are explanatory diagrams of the operation of the printing liquid container 110 according to the first exemplary embodiment of the present invention. FIG. 11A is a diagram showing the state prior to a hole being pierced in the sealing membrane 138 by the hole piercing tool 80, and FIG. 11 B is a diagram showing the state after a hole has been pierced. Note that the shape of pierced hole in the sealing membrane 138 illustrated in FIG. 11B is shown schematically, and actual pierced hole states are different therefrom.

The sealing membrane 138 of the printing liquid container 110 according to the first exemplary embodiment, as shown in FIG. 11A and FIG. 11B, has a hole pierced in it by the hole piercing tool 80. When the hole piercing tool 80 is piercing a hole in the sealing membrane 138, stress is concentrated at the contact portion 140 due to the hole piercing tool 80 making contact with the contact portion 140 formed at the central portion of the sealing membrane 138, as illustrated in FIG. 10. Accordingly, at the first rupture portions 144 that are configured thinner than the sealing membrane 138, stress is not readily transmitted from the contact portion 140 to the outer peripheral portion side of the sealing membrane 138 and overall rupturing of the first rupture portions 144 can be achieved, enabling the opening surface area of the sealing membrane 138 to be made larger.

Due to the rupture inducing guide portion 146 being formed at the outer periphery of the contact portion 140 and the rupture inducing guide portion 146 being configured thinner than the sealing membrane 138 and connected to the first rupture portions 144, in order to induce rupturing of the first rupture portions 144, the stress concentrated at the contact portion 140 is transmitted to the rupture inducing guide portion 146 that is formed at the outer periphery of the contact portion 140 and configured thinner than the sealing membrane 138 (than the contact portion 140 and the surround portion 142), rupturing the rupture inducing guide portion 146. Rupturing of the first rupture portions 144 connected together by the rupture inducing guide portion 146 can accordingly be induced.

The hole piercing tool 80 can also be guided towards the contact portion 140 due to the rupture inducing guide portion 146 being formed at the outer periphery of the contact portion 140.

Furthermore, due to the contact portion 140 being indented from the front surface of the sealing membrane 138 (the surround portion 142) and protruding out from the back face thereof, the leading end of the hole piercing tool 80 makes contact with the contact portion 140 when inserted further from the front surface of the sealing membrane 138, enabling misalignment of the hole piercing tool 80 to be reduced. Due to the thickness achieved by the contact portion 140 protruding out from the back face of the sealing membrane 138 the hole piercing tool 80 does not simply pass through the contact portion 140.

Due to the first rupture portions 144 being formed as substantially S-shaped curved line groove portions, the length of the first rupture portions 144 is greater than, for example, were they to be configured by straight line groove portions, increasing the rupture length and increasing the opening surface area of the sealing membrane 138. Since there are plural of the first rupture portions 144 configured by such curved line groove portions in the sealing membrane 138, the opening surface area of the sealing membrane 138 can be increased even further.

Furthermore, due to the S-shape being different from the shape of the hole piercing tool 80 (a cross shape), the first rupture portions 144 are ruptured to open the sealing membrane 138 even if the sealing membrane 138 adheres to the hole piercing tool 80, enabling liquid to flow out from the opening 114 to outside.

The cap main body 122 is provided with the second rupture portions 148, formed along the outer peripheral portion of the sealing membrane 138, connected to the first rupture portions 144 and configured thinner than the sealing membrane 138 (the contact portion 140 and the surround portion 142). Accordingly, when a hole is pierced in the sealing membrane 138 with the hole piercing tool 80, the second rupture portions 148 connected to the first rupture portions 144 are also ruptured by rupturing of the first rupture portions 144. Furthermore, the outer peripheral portion of the sealing membrane 138 is opened when at least a portion of the second rupture portions 148 ruptures, enabling contact resistance to the hole piercing tool 80 to be reduced when the hole piercing tool 80 has been pushed through and out from the sealing membrane 138, and enabling abrasion debris of the sealing membrane 138 to be prevented from occurring.

By providing plural of the second rupture portions 148 the contact resistance to the hole piercing tool 80 is reduced and also, by leaving a specific separation between the plural second rupture portions 148, un-ruptured locations can be left remaining at the outer peripheral portion of the sealing membrane 138, namely joining locations of the cap main body 122 to the sealing membrane 138, and the sealing membrane 138 may be prevented from peeling away and falling off from the cap main body 122.

The capping section 94 is configured to plug into the opening 114, enabling the configuration of the capping section 94 to be simplified, and enabling the capping section 94 and the opening 114 to be reliably fitted together without a complicated operation, such as an operation requiring torque control with an ordinary screw cap.

The capping section 94 is equipped with the cylindrical cap main body 122 and the hook portion 130 provided to project out from the outer peripheral wall 122B of the cap main body 122. The hook portion 130 latches to the latching portion 132 formed in the inner peripheral wall 114A of the opening 114. Accordingly, the capping section 94 may be prevented from coming out from the first rupture portions 144 due to liquid pressure.

The latching portion 132 is formed with the space 134 at the inner peripheral wall 114A of the opening 114, to enable the leading end of the cylindrical cap main body 122 serving as the cylinder body to deform in the diameter-widening direction. Accordingly, the leading end of the cap main body 122 deforms in the diameter-widening direction with increased internal pressure due, for example, to an impact, making latching between the hook portion 130 and the latching portion 132 even stronger. Accordingly, the capping section 94 may be prevented from coming out from the opening 114.

The printing liquid filled container arising from filling the printing liquid container 110 with ink may be obtained by manufacturing including: preparing the liquid pack 113 formed with the opening 114 for filling ink, filling ink into the liquid pack 113, and plugging the capping section 94 configured as described above into the opening 114.

[Second Exemplary Embodiment]

Figure 12:
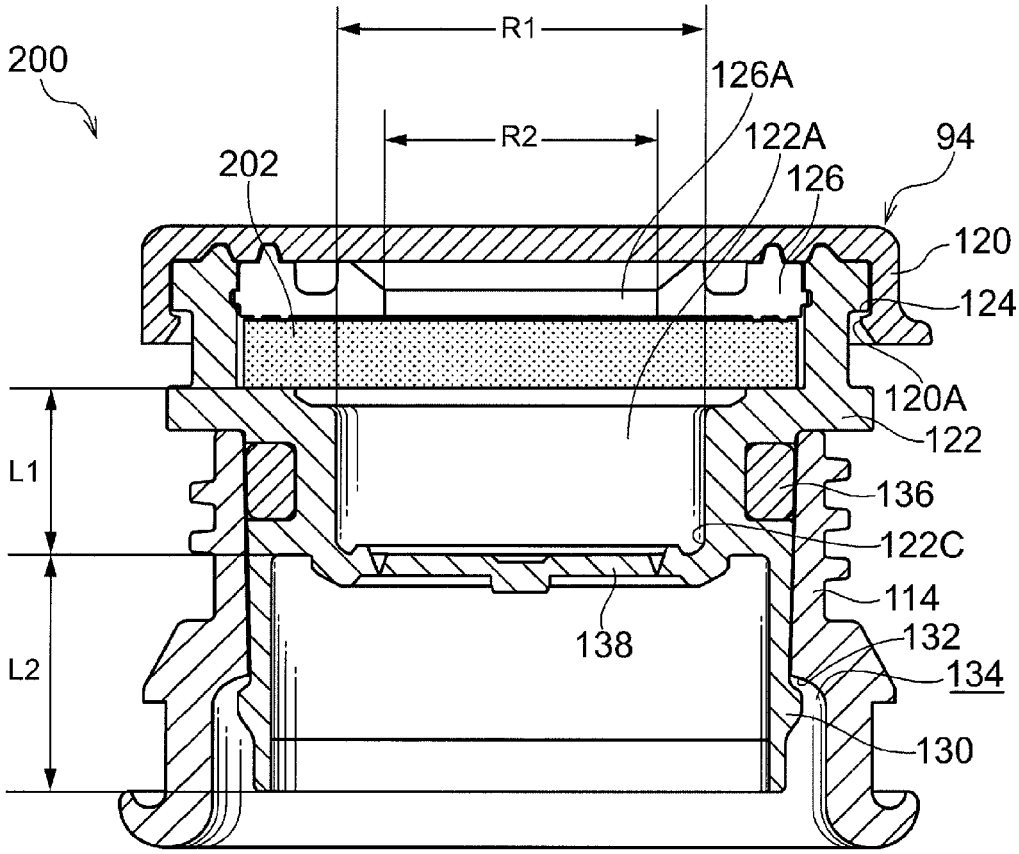
FIG. 12 is a cross-sectional view illustrating a configuration of a capping section of a printing liquid container according to a second exemplary embodiment of the present invention.

Explanation follows regarding a printing liquid container accordingly to a second exemplary embodiment of the present invention. FIG. 12 is a cross-sectional diagram illustrating a configuration of a capping section of a printing liquid container according to the second exemplary embodiment of the present invention.

Printing Liquid Container

A printing liquid container 200 according to the second exemplary embodiment is similar to the configuration of the printing liquid container 110 according to the first exemplary embodiment, however a resilient sealing member 202 is provided in place of the support plate 128 of the capping section 94.

The resilient sealing member 202 is attached inside the capping section 94 further towards the capping section 94 opening side than the sealing membrane 138, and is a member for sealing the opening 114 together with the sealing membrane 138. However, in contrast to the sealing membrane 138, the resilient sealing member 202 can seal the opening 114 even after the sealing membrane 138 has been pierced, as explained below.

A separation L1 between the resilient sealing member 202 and the sealing membrane 138 is preferably set as long as possible, for example at 10.0 mm, from the perspective of achieving a time difference between the timing of pulling the hole piercing tool 80 out from the sealing membrane 138, and the timing of pulling the hole piercing tool 80 out from the resilient sealing member 202. There are no particular limitations to a separation L2 between the sealing membrane 138 and the inside leading end of the cap main body 122 (on the printing liquid container 200 side), and is, for example, 14.3 mm. The diameter R1 of the through hole 122A at the vicinity of the sealing membrane 138 is, for example, 21.4 mm, and the diameter R2 of the through hole 126A formed in the press plate 126 is, for example, 15.5 mm.

Figure 13:
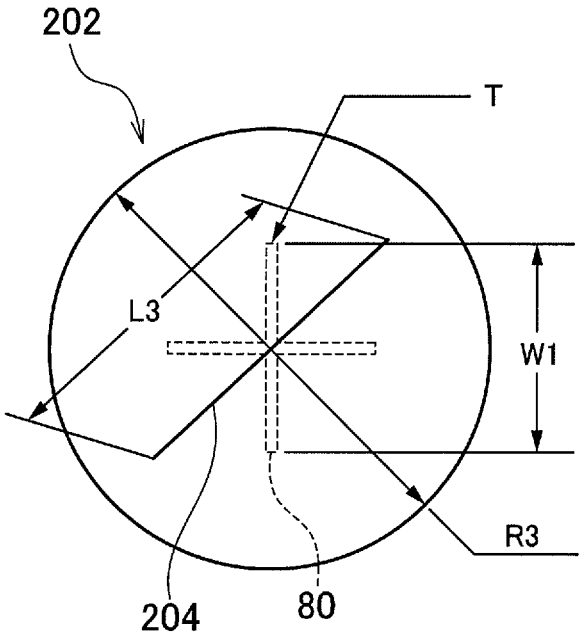
FIG. 13 is a fort view of a resilient sealing member.

FIG. 13 is a front view of the resilient sealing member 202.

The resilient sealing member 202 is made from silicone rubber, has resilient properties, and is formed in a circular plate shape. There are no particular limitations to the diameter R3 of the resilient sealing member 202, which is, for example, 32.0 mm.

A single line shaped slit (incision) 204 is provided at the center of the circular shaped face of the resilient sealing member 202, passing through from one side to the other side. The slit 204 is normally closed due to the resilient force of the resilient sealing member 202, not to let liquid flow through the slit 204. However, the slit 204 is pushed out wider by the hole piercing tool 80 when piercing a hole in the sealing membrane 138 with the hole piercing tool 80, enabling liquid to flow out from the slit 204.

A length L3 of the slit 204 is, for example, 20.0 mm. There are no particular limitations to the width direction width W1 of the hole piercing tool 80 however, in the present exemplary embodiment, the width W1 is, for example, 15.0 mm. The thickness T of the hole piercing tool 80 is, for example, 1.0 mm.

Operation

Explanation follows regarding the operation of the printing liquid container 200 according to the second exemplary embodiment of the present invention.

Figure 14A:
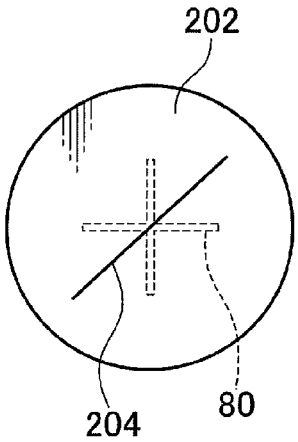
FIG. 14A is an explanatory diagram illustrating a state prior to hole piercing by a hole piercing tool in a printing liquid container according to a second exemplary embodiment of the present invention.
Figure 14B:
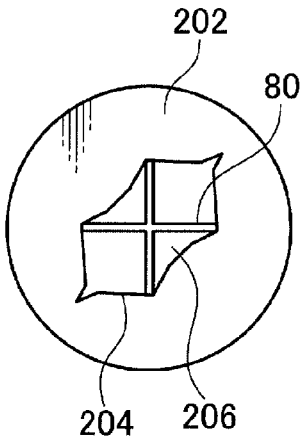
FIG. 14B is an explanatory diagram illustrating a state part-way through hole piercing by a hole piercing tool in a printing liquid container according to a second exemplary embodiment of the present invention.
Figure 14C:
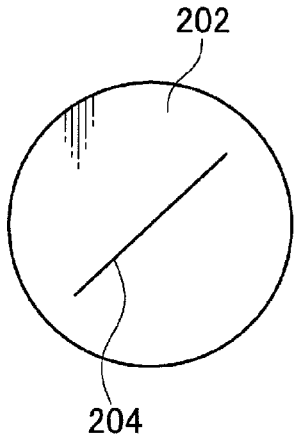
FIG. 14C is an explanatory diagram illustrating a state after hole pierced by a hole piercing tool in a printing liquid container according to a second exemplary embodiment of the present invention.

FIGS. 14A to FIG. 14C are explanatory diagrams of the operation of the printing liquid container 200 according to the second exemplary embodiment of the present invention. FIG. 14A illustrates a state prior to piercing a hole with the hole piercing tool 80, FIG. 14B illustrates a state partway through piercing a hole with the hole piercing tool 80, and FIG. 14C illustrates a state after piercing a hole with the hole piercing tool 80.

As shown in FIG. 14A and FIG. 14B, when the hole piercing tool 80 is inserted into the capping section 94, the slit 204 of the resilient sealing member 202 is pushed out wider by the hole piercing tool 80 into a substantially rectangular shape. When the length of the single line shaped slit 204 prior to pushing out wider is denoted L3 as described above, and the sum of the lengths of the four sides of the rectangular shaped slit 204 after pushing out wider by the hole piercing tool 80 is increased in a range up to 10%, then the slit length of the range increases from 2×L3 to 2×L3×110%.

Liquid inside the liquid pack 113 starts to flow out downwards when the sealing membrane 138 is ruptured by the hole piercing tool 80. The liquid is guided through a space 206 secured between the outer wall faces of the hole piercing tool 80 and the inner wall faces of the slit 204 that has been pushed out wider into a rectangular shape, and fed through the distribution tubes 46 to the connection destination that is the main ink tank 21. In comparison to a case in which the hole piercing tool 80 is configured from a hollow needle such as an injection needle with the liquid being discharged through the hollow portion of the needle, the path for discharging the liquid (the space 206) is not formed with flow path walls that obstruct liquid discharge, and liquid does not remain in the vicinity of the opening. Namely, a configuration is achieved in which the flow path (the 206) secured by the outer wall faces of the hole piercing tool 80 and the inner wall faces of the slit 204 contribute to the total discharge of the liquid.

When, from the state shown in FIG. 14B, the hole piercing tool 80 is pulled out from the opening 114, the slit 204 of the resilient sealing member 202 reverts to a single line shape due to the resilient force of the resilient sealing member 202, as shown in FIG. 14C. Accordingly, even if any liquid was to remain in the liquid pack 113, such remaining liquid can be prevented from leaking out.

[Alternative Examples]

Note that, while the present invention has been explained in detail by way of the particular first and second exemplary embodiments, the present invention is not limited by these exemplary embodiments, and it will be obvious to a person of skill in the art that various other exemplary embodiments are possible within the scope of the present invention. For example, appropriate combinations may be implemented from among plural of the above exemplary embodiments. Appropriate combinations may also to be made with the following modified examples.

For example, in the first exemplary embodiment, configuration has been made such that the liquid pack 113 housed in the carton 112 is installed in the carton adaptor 92. However the liquid pack 113 may be installed directly in the carton adaptor 92, without employing the carton 112.

Explanation has been given of cases in which the thickness of the first rupture portions 144 is similar to the thickness of the rupture inducing guide portion 146. However configuration may be made such that the thickness of the first rupture portions 144 is thicker than the thickness of the rupture inducing guide portion 146. In such cases the rupture inducing guide portion 146 is ruptured by the stress concentrated at the contact portion 140 prior to the first rupture portions 144 being ruptured, and rupturing of the first rupture portions 144 may be reliably induced.

As an alternative, the thickness of the first rupture portions 144 may be made thinner than the thickness of the rupture inducing guide portion 146. In such cases the rupture inducing guide portion 146 may be prevented from completely rupturing and the contact portion 140 can be prevented from peeling away and falling off.

While explanation has been given of cases in which the contact portion 140 is indented from the front face of the surround portion 142 and projects out from the back face, configuration may be made such there is no step between the surfaces of the contact portion 140 and the surround portion 142. Configurations may also be made in which the contact portion 140 is indented from the back face of the surround portion 142 and protrudes out from the front face. By making the contact portion 140 protrude out from the front face, the hole piercing tool 80 can reliably be made to first make contact the contact portion 140.

In the above "liquid" is not limited to ink, and there are no particular limitations to the liquid as long as it is a liquid that can be jetted and the definition of liquid includes, for example, DNA samples, resists and patterning materials.

Explanation has been given of cases in which the first rupture portions 144 are configured by substantially S-shaped curved line groove portions in plan view, however a straight line shape or a saw-tooth shape can be employed therefor.

The invention claimed is:

1. A printing liquid container comprising:

a container main body formed with an opening to fill a liquid for printing;

a capping section connected to the opening;

a sealing portion provided to the capping section to seal the opening;

a contact portion formed at a central portion of the sealing portion and contacted by a hole piercing tool to pierce a hole in the sealing portion;

a first rupture portion configured thinner than the sealing portion and extending from the contact portion to an outer peripheral portion of the sealing portion; and a rupture inducing guide portion formed at an outer periphery of the contact portion, configured thinner than the sealing portion, and connected to the first rupture portion to induce and guide rupturing of the first rupture portion.

2. The printing liquid container of claim 1, wherein the contact portion is indented from a front surface of the sealing portion and protrudes out from a rear face of the sealing portion.

3. The printing liquid container of claim 1, wherein a thickness of the first rupture portion is configured thicker than a thickness of the rupture inducing guide portion.

4. The printing liquid container of claim 1, wherein a plurality of the first rupture portions are provided as curving line shaped groove portions in the sealing portion when viewed in plan view.

5. The printing liquid container of claim 4, wherein the curving line shape is an S-shape.

6. The printing liquid container of claim 1, further comprising:

a second rupture portion formed along an outer peripheral portion of the sealing portion, connected to the first rupture portion, and configured thinner than the sealing portion.

7. The printing liquid container of claim 6, wherein a plurality of second rupture portions are provided at specific separations from each other.

8. The printing liquid container of claim 1, wherein the capping section is plugged into the opening.

9. The printing liquid container of claim 8 wherein:

the capping section comprises a cylinder body and a hook portion that projects out from an outer peripheral wall of the cylinder body; and the hook portion latches together with a latching portion formed to an inner peripheral wall of the opening.

10. The printing liquid container of claim 9, wherein a space is configured at an inner peripheral wall of the opening portion where the latching portion is formed, and the space enables the leading end of the cylinder body to deform in a diameter-widening direction.

11. The printing liquid container of claim 1, further comprising:

a resilient sealing member provided further to the capping section opening side than the sealing portion, and formed with a slit.

12. A printing liquid filled container comprising:

the printing liquid container of claim 1, which has been filled with a liquid for printing.

13. An image forming apparatus comprising:

the printing liquid container of claim 1; and the hole piercing tool to pierce a hole in the sealing portion, wherein the hole piercing tool is configured with a different shape from the shape of the first rupture portion.

14. A printing liquid filled container manufacturing method comprising:

providing the printing liquid container of claim 1;

filling the container main body with the liquid for printing; and plugging the capping section into the opening.

15. The printing liquid filled container manufacturing method of claim 14 wherein:

the capping section comprises a cylinder body and a hook portion that projects out from an outer peripheral wall of the cylinder body; and the hook portion latches together with a latching portion formed at an inner peripheral wall of the opening.

16. The printing liquid filled container manufacturing method of claim 15, wherein a space is configured at an inner peripheral wall of the opening portion where the latching portion is formed and the space enables the leading end of the cylinder body to deform in a diameter-widening direction.

17. The printing liquid filled container manufacturing method of claim 14, wherein the capping section comprises a resilient sealing member that is provided further to the capping section opening side than the sealing portion, and wherein a slit is formed in the resilient sealing member.

* * * * *